US009188392B2

(12) United States Patent
Sarres et al.

(10) Patent No.: US 9,188,392 B2
(45) Date of Patent: Nov. 17, 2015

(54) METHOD AND INDUSTRIAL FURNACE FOR USING A RESIDUAL PROTECTIVE GAS AS A HEATING GAS

(75) Inventors: Rolf Sarres, Oberhausen (DE); Wilhelm van de Kamp, Kleve (DE)

(73) Assignee: IPSEN, INC., Cherry Valley, IL (US)

( * ) Notice: Subject to any disclaimer, the term of this patent is extended or adjusted under 35 U.S.C. 154(b) by 658 days.

(21) Appl. No.: 13/437,294

(22) Filed: Apr. 2, 2012

(65) Prior Publication Data

US 2012/0276494 A1 Nov. 1, 2012

(30) Foreign Application Priority Data

Apr. 5, 2011 (DE) ..... 10 2011 016 175

(51) Int. Cl.

| | |
|---|---|
| ***F27D 19/00*** | (2006.01) |
| ***F27B 3/22*** | (2006.01) |
| ***F27B 3/04*** | (2006.01) |
| ***F27B 9/04*** | (2006.01) |
| ***F27D 17/00*** | (2006.01) |
| ***C21D 1/74*** | (2006.01) |
| ***F27D 7/00*** | (2006.01) |

(52) U.S. Cl.

CPC ..... *F27D 17/008* (2013.01); *C21D 1/74* (2013.01); *F27D 7/00* (2013.01)

(58) Field of Classification Search

CPC ..... F27D 2007/045; F27D 7/00; F27D 17/00; F27D 17/008; C21D 1/74

USPC ..... 432/23, 4, 49; 431/26, 164, 170; 110/234

See application file for complete search history.

(56) References Cited

U.S. PATENT DOCUMENTS

| | | | | |
|---|---|---|---|---|
| 3,644,099 | A * | 2/1972 | Crans | 422/615 |
| 4,811,723 | A * | 3/1989 | Vaananen | 126/113 |
| 4,869,730 | A * | 9/1989 | Bhatnagar et al. | 48/113 |
| 5,269,171 | A * | 12/1993 | Boyer | 73/40.5 R |
| 6,179,212 | B1 * | 1/2001 | Banko | 236/1 E |
| 6,969,250 | B1 * | 11/2005 | Kawamura et al. | 431/185 |
| 2005/0106429 | A1 * | 5/2005 | Keefer | 429/20 |
| 2008/0241018 | A1 * | 10/2008 | Sugiyama et al. | 422/187 |
| 2011/0042866 | A1 * | 2/2011 | Grobler et al. | 266/44 |
| 2011/0139265 | A1 * | 6/2011 | Grobler et al. | 137/14 |

FOREIGN PATENT DOCUMENTS

| | | | | |
|---|---|---|---|---|
| DE | 3432952 | | 3/1986 | |
| DE | 19720620 | | 8/1998 | |
| DE | 19720620 | A1 * | 8/1998 | F27D 17/00 |
| EP | 0282715 | | 9/1988 | |

* cited by examiner

*Primary Examiner* — Steven B McAllister
*Assistant Examiner* — Steven Anderson, II
(74) *Attorney, Agent, or Firm* — Dann, Dorfman, Herrell and Skillman, P.C.

(57) ABSTRACT

In order to increase energy efficiency in an industrial furnace (1) operated by heating gas and protective gas for thermally treating materials, a first burner (3.1) is actuated for heating with priority over a second burner (3.2), the second burner (3.2) is engaged additionally and operated when the output from the first burner (3.1) falls below the level necessary to heat the industrial furnace (1) up to a temperature setpoint, and the second burner (3.2) is switched off when the temperature setpoint has been reached.

3 Claims, 2 Drawing Sheets

METHOD AND INDUSTRIAL FURNACE FOR USING A RESIDUAL PROTECTIVE GAS AS A HEATING GAS

BACKGROUND OF THE INVENTION

1. Field of the Invention

The invention relates to a method and an industrial furnace for using a residual protective gas as a heating gas, primarily for use in an industrial furnace such as a multichamber furnace or a pusher type furnace, which comprises a high-temperature furnace and an upstream preheating furnace. The method according to the invention may be applied to any processes and industrial furnaces where materials undergo thermal treatment using a heating gas and a protective gas.

2. Description of the Related Art

As described for example in DE 10 2008 020 449 A1, industrial furnaces have been designed in such manner that a fundamentally energy-efficient operating arrangement can be established. However, the known arrangements have been limited to the requirement that insulating covers are provided that at least partially surround the housings and are separated from the housing wall, and that convection cavities can be created between the housing wall and the insulating cover.

It would be desirable to improve energy usage efficiency of industrial heat treating furnaces by using gases such as the protective gases from the outset.

From a technical functional perspective, the endogas used in industrial heat treating furnaces may be defined as a gas mixture that is created in a generator and is used as a protective gas before an oxidation process. Such furnaces are referred to as atmosphere furnaces in contrast to "air" or "vacuum furnaces."

In industrial atmosphere furnaces, a gas mixture that protects the component that is to undergo thermal treatment from undesirable chemical reactions may be used as a protective gas. Thus for example nitrogen is used as a protective gas to protect against oxidation and carburisation as well as decarburisation.

An endogas can serve as a protective gas from oxidation because carbon is given off. Endogas is therefore not a carbon carrier gas that is used for carburising components.

For the purposes of the invention, the residual protective gas does also include that which is referred to as endogas, a term which is commonly used in technical circles but is of limited practical application, but the invention is not limited solely to residual endogas.

Regarding industrial furnaces that work with protective gas, the technical community has already directed substantial efforts towards reducing pollutant emission values, as has been described in EP 0 282 715 for example.

But beyond this, it is also important to use the energy contained in the gases that are not consumed in the process.

In this context, processes for using the energy content in furnace flue gases that escape from industrial furnace installations are noteworthy:

According to DE 34 32 952C2 the stated object is to suggest a way in which the burners that burn fuel gases in the vicinity of the furnace openings while the furnace is being opened may be operated simply and economically. According to the invention, the furnace flue gas in this region should be cooled, compressed and stored, and then at least some of it should be forwarded as fuel gas to one or more burners in the area of the furnace openings. A suitable device for this purpose is suggested in the reference.

When flue gas is used as the fuel, the heat shields may be formed without relying on petroproducts at all.

A further improved and known method for using the energy content of furnace flue gases that escape from industrial furnace installations is described in DE 197 20 620 A1 and provides for collecting at least a portion of such gases and re-using them for heating, possibly with the admixture of an additional heating medium.

A variation of the known method consists of drawing the furnace flue gas off from at least one major escape point from the furnace and feeding it to one or more standard radiant heater tubes in the furnace with the aid of a blower while mixing another fuel substance with it, if necessary.

In this case, the flue gases may be supplied under additional pressure or even through the intake of a burn.

In industrial furnace installations that are known as being species-related, including those that comprise multiple chambers or treatment chambers, such as are also found in pusher furnace systems for example, process steps known to the Applicant are carried out as follows depending on the process gases used:

a) Gas Ignition and Burner Ignition in a Pusher Furnace

In the present case, natural gas is supplied in an assigned preheater furnace via a ring main of a high-temperature furnace, in which initially the gas supply is triggered. Then, an automatic start routine is performed in a controller, during which a leak test of the ring main is carried out.

b) Gas Ignition and Burner Ignition in the Preheater Furnace

As in step a), here too the automatic start routine is run in the controller. If "open burners" are used here, the industrial furnace must first be brought into a safe basic state. To do this, first the furnace doors are closed and the industrial furnace is purged for example with a volume of air equal to five times the volume of the furnace through air lines of the associated burners. Then a leak test is performed on the heating gas and the natural gas lines using a leak test unit. The furnace doors are opened again before the burner is ignited. This burner and a pilot burner are then ignited. When a stable burner flame is reported, for example by ionisation monitors, the furnace doors are closed again and the preheater furnace is heated up to its operating temperature by the burner (functioning as a heating burner), and the pilot burner stays alight until the preheater furnace is switched off again.

c) Gas Feed to the Pusher Furnace

When the temperature has risen above at least 750° C. for example, protective gas can be fed into the pusher furnace. Depending on the feed system, a protective atmosphere such as "endogas" or nitrogen/methanol is fed into the system as the carrier gas. The gas feed to the pusher furnace is properly completed when an overpressure set via a combustion excess pressure flap is reached and a target carbon level has also been established inside the furnace.

An analysis of these process steps showed that because of the need to burn off the escaping flue gases the use of this endogas and protective gas combustion to increase the energy efficiency of an industrial furnace is in need of improvement.

BRIEF SUMMARY OF THE INVENTION

The object of the invention is to increase the efficiency of using protective gas and endogas combustion in industrial furnaces generally and in multichamber and pusher furnaces particularly, and to make more efficient use of the residual protective gas, which until now has escaped without further use, as a heating gas, as for example in a high temperature and preheater furnace that includes the pusher furnace installations as well.

This object for the process conditions of an industry furnace is solved with the invention in such manner that to begin with the steps of a) Gas ignition and burner ignition in an industrial furnace, b) Gas ignition and burner ignition in an associated preheater furnace and/or c) Gas feed to the industrial furnace may still be performed as described above, but those steps are then followed according to the invention by the further step of d) Setting a first burner as the protective gas burner, wherein the subsequent steps and/or conditions according to the invention, that is to say e) Ignition of the first burner, f) Operation of the first burner, g) Shutdown of the first burner, h) Failure of the first burner, i) Monitoring of insufficient pressure upstream of the first burner when the first burner is in operation may then be performed or maintained automatically.

To this end, it is suggested as follows:

1. Use of the first burner as the protective gas burner, in which the protective gas is combusted together with a heating gas that has a lower calorific value, such as natural gas, wherein
   - in order to ensure reliable ignition of the protective gas for the first burner as the protective gas burner a permanently burning third burner fuelled by a heating gas such as natural gas is used as the pilot burner and/or
   - a UV sensor is used for monitoring a burner flame;
2. a function-preserving supply of the first burner (protective gas burner) via a blower that draws the protective gas for example out of an inlet lock of the furnace system, such as a pusher furnace system, wherein
   - the blower is frequency-controlled to regulate the quantity of gas drawn off,
   - the gas is cooled in a gas chiller to protect it from overheating;
   - the pressure of the gas is adjusted to the level necessary for the first burner by means of the blower,
   - the pressure in the line is monitored constantly with the aid of a pressure sensor, for example, and is maintained within a given pressure range by means of a frequency transducer on the blower, and/or
   - is controlled with constant monitoring of the furnace pressure with the aid of a furnace pressure measuring transducer;
3. the additional use of a second burner as the actual heating gas burner or of a conventional heating burner exclusively for heating the preheater furnace for example in case no protective gas is available from the pusher furnace for example, wherein the operational first burner as the protective gas burner is used primarily to heat the furnace and the second burner as the heating burner is only engaged if the output from the first burner is not sufficient for heating.

Providing the preceding process conditions a) to c) are maintained and after the preceding step d), that is to say the setting of the first burner as the protective gas burner, this general process according to the invention is enhanced according to the invention by the following steps:

e) Ignition of the first burner

Before the first burner is ignited as the protective gas burner, a leak check is first carried out in the furnace installation such as the pusher furnace by means of a leak test unit in similar manner to the ignition of the second burner (heating gas burner, natural gas burner). For this, an inlet pressure must be present in a main valve such as a gas solenoid valve in the line for the protective gas. The blower described above is switched on before the leak test and forces the protective gas towards the closed main valve. A burn-off point, for example at an inlet lock of the furnace, is open during the leak test, since no gas is yet being discharged from the furnace via the first burner during this time. The first burner is ignited and the burn-off point is closed after the leak test.

The subsequent step according to the invention consists in the following:

f) Operation of the first burner

After the first burner has been ignited as the protective gas burner, it has priority over the second burner during operation. This means that the second burner, as the actual heating or natural gas burner, is only engaged as well if the output from the first burner is not sufficient to reach the setpoint temperature in the furnace installation, for example the preheater furnace. Conversely, it also means that the second burner is switched off as a protective gas burner when the setpoint for the furnace is reached. If the temperature then continues to rise, the output from the first burner as the protective gas burner may be reduced progressively for example via an air control damper as a throttle valve for the air.

If the temporarily reduced quantity of gas drawn off from the pusher furnace for example causes the furnace pressure to rise slightly, this is acceptable within limits, since correspondingly more gas may be discharged via a burn-off point—also at an oil bath for example. Even so, the first burner as the protective gas burner is switched off when a defined maximum value for the furnace pressure is reached, and the burn-off point at the inlet lock is opened. This causes the furnace pressure to fall again rapidly. If the preheater furnace needs energy for preheating again, the first burner is switched on as the protective gas burner.

The following situation may optionally be taken into account and developed as a process step according to the invention:

g) Switching off the first burner

If the industrial furnace such as a pusher furnace is in operating states in which a reliable supply of protective gas to the first burner is not assured, the first burner is switched off and heating of the preheater furnace for example is carried out solely via the second burner as the natural gas or heating gas burner. This may be the case then the doors are opened for example. After the doors have opened, the first burner as protective gas burner is not switched on again until the furnace pressure has reached a predetermined setpoint.

The following operating situation may be organised with a further step according to the invention:

h) Failure of the first burner as the protective gas burner

If the first burner should fail and not be capable of restarting due to a malfunction, a main valve such as a solenoid valve is closed and the blower is switched off promptly, and a shutoff valve is opened. In this case, the second burner as the natural gas or heating burner heats the preheating furnace alone.

Finally, the invention also improves the following situation:

i) Insufficient pressure upstream of the first burner

The inlet pressure upstream of the first burner serves as a control variable for the frequency transducer of the blower for the protective gas. The target is to maintain a constant inlet pressure of for example approximately 20-30 mbar. If this pressure falls, the speed of the blower is increased via the frequency transducer.

The foregoing sequences can be better understood with reference to FIG. 2 of the drawings.

When all elements are combined, the method according to the invention incorporating the steps described in the introduction and an associated device may operate on an industrial furnace configured as a pusher furnace and including a preheater furnace connected upstream from a high-temperature furnace in such manner that the output from the first burner as the protective gas burner is regulated constantly while the preheater furnace is in operation in order to obtain the best possible yield from the quantity of protective gas made available from the high-temperature furnace:

The available quantity of protective gas is initially determined when the system is commissioned by adjusting the burn-off quantities from the high-temperature furnace, and from the oil bath if applicable, relative to the escape volume and then adjusting the furnace pressure using the weight load of non-return valves at the burn-off points.

Then, following these adjustment activities the high-temperature furnace will be supplied continuously with protective gas. In this way, the volume flow of protective gas with which the first burner as the protective gas burner can be supplied is fixed. Thus, the conditions are met for ensuring that it is possible to burn exactly as much protective gas as may be burned in the manner of a heating gas as would be discharged according to the prior art or otherwise from the burn-off point at the inlet lock of the high-temperature furnace.

This is why the furnace pressure of the high-temperature furnace is used as the control variable for the first burner. If the furnace pressure rises, an air damper flap before the first burner is opened, causing the output and thus also the gas consumption of the first burner to rise.

If the increased gas consumption of the first burner causes the inlet pressure upstream of the first burner to fall, the speed of the blower is increased by a frequency transducer so that the displacement volume increases. The blower continues to operate faster until a constant inlet pressure of 20-30 mbar for example is re-established upstream of the first burner.

If the furnace pressure falls, the air damper flap is closed again to reduce the first burner's output.

As is standard practice when a conventional natural gas burner is used as a heating gas burner, a leak test is performed before the first burner is ignited (it is practical to use a leak test unit compliant with TC410 manufactured by Kromschröder for this purpose).

Before the leak test can be carried out, an inlet pressure must be present upstream of the main valve in the feed line for the protective gas. For this reason, the blower is switched on before the leak test is performed and forces the gas towards the closed main valve.

The burn-off point of the high-temperature furnace is open during the leak test, since no gas is yet being discharged from the furnace via the first burner in this state (that is to say at this time). The first burner is only ignited and the burn-off point closed after the leak test has been completed successfully.

After the first burner has been ignited in this way, the processes according to the invention function in such a way that the operation of the first burner as the protective gas burner takes precedence over the second burner as the heating burner.

This means that the second burner is only ever engaged additionally if the output from the first burner is not sufficient to reach the temperature setpoint for the preheater furnace.

Conversely, the second burner is always switched off first when the setpoint for heating the furnace is been reached. The first burner's output may only be reduced progressively via the air damper flap if the temperature continues to rise after this.

If the temporarily reduced quantity of gas drawn off from the high temperature furnace causes the furnace pressure to rise slightly, this is acceptable within limits, since correspondingly more gas may be discharged via a burn-off point—at the oil bath for example.

In general, the first burner is switched off and the burn-off point at the inlet lock is opened when a maximum value for the furnace pressure, still to be defined, is reached. In this way, the furnace pressure is quickly lowered again. If the preheater furnace needs heating energy for this purpose again, the first burner is switched on again anyway.

The first burner is only switched off if the high-temperature furnace is in operating states in which a reliable supply of protective gas to the first burner is not assured. Heating of the preheater furnace is then carried out solely via the second burner as the heater burner.

This situation may occur for example while the doors are being opened. For this reason, the first burner is switched on again as the protective gas burner after the doors have been opened when the furnace pressure has reached the setpoint.

If the first burner as the protective gas burner should fail and not be capable of restarting due to an unexpected malfunction, the main valve is closed, the blower is switched off, and the shutoff valve is opened. In this case, the second burner continues heating the preheating furnace alone.

If the pressure upstream of the first burner is too low, the inlet pressure upstream of the first burner serves as a control variable for the frequency transducer of the blower. The objective is to maintain a constant inlet pressure of for example 20-30 mbar. If the pressure falls, the speed of the blower is increased via the frequency transducer.

The invention disclosed herewith is defined according to the industrial furnace that comprises the features set forth in the claims.

The invention will be described on the basis of an example including an industrial furnace and the process and with reference to a schematic drawing.

DETAILED DESCRIPTION OF THE INVENTION

Figure 1:
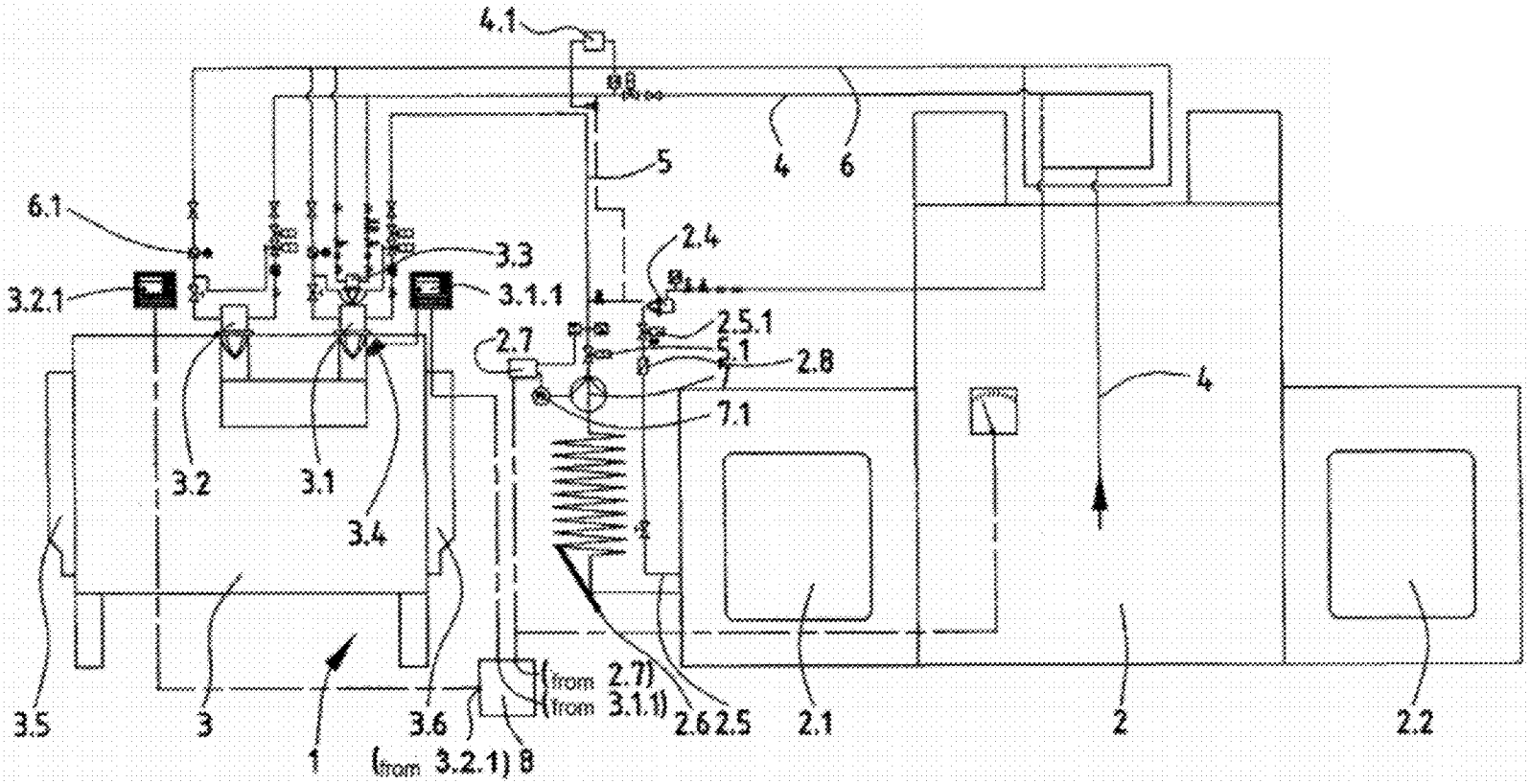
FIG. 1 shows the functional diagram of an industrial furnace according to the invention for performing the process using the example of pusher furnace with a high-temperature furnace and a preheater furnace.

As shown in FIG. 1, an industrial furnace 1 configured as a pusher furnace system comprises a high-temperature furnace 2 having one door for charging 2.1 and one door for removing 2.2 batches of components destined for thermal treatment and a flue gas burner 2.4. located at a burn-off point 2.5, a shutoff valve 2.5.1 and an excess pressure flap 2.8 being assigned to the flue gas burner.

A preheater furnace 3 having one door for loading 3.5 and one door for unloading 3.6 batches of components destined for thermal treatment is located upstream of high temperature furnace 2, which preheater furnace includes a first burner 3.1 having a controller 3.1.1 and a second burner 3.2 having a second controller 3.2.1.

The industrial furnace 1 configured in this way receives a supply line for a heating gas 4 with a leak testing unit 4.1, a supply line 5 with a main valve 5.1 for a protective gas that may be transported by means of a blower 7 and cooled by means of a gas chiller 2.6 and controlled by means of a third controller 2.7, and a supply line for air 6 with an air damping flap 6.1 as a throttle valve.

A control and adjustment unit 8 links first controller 3.1.1, second controller 3.2.1 and the third controller 2.7 for the functions of the process workflow for using the residual protective gas according to the invention as a heating gas as explained in the following process description.

Figure 2:
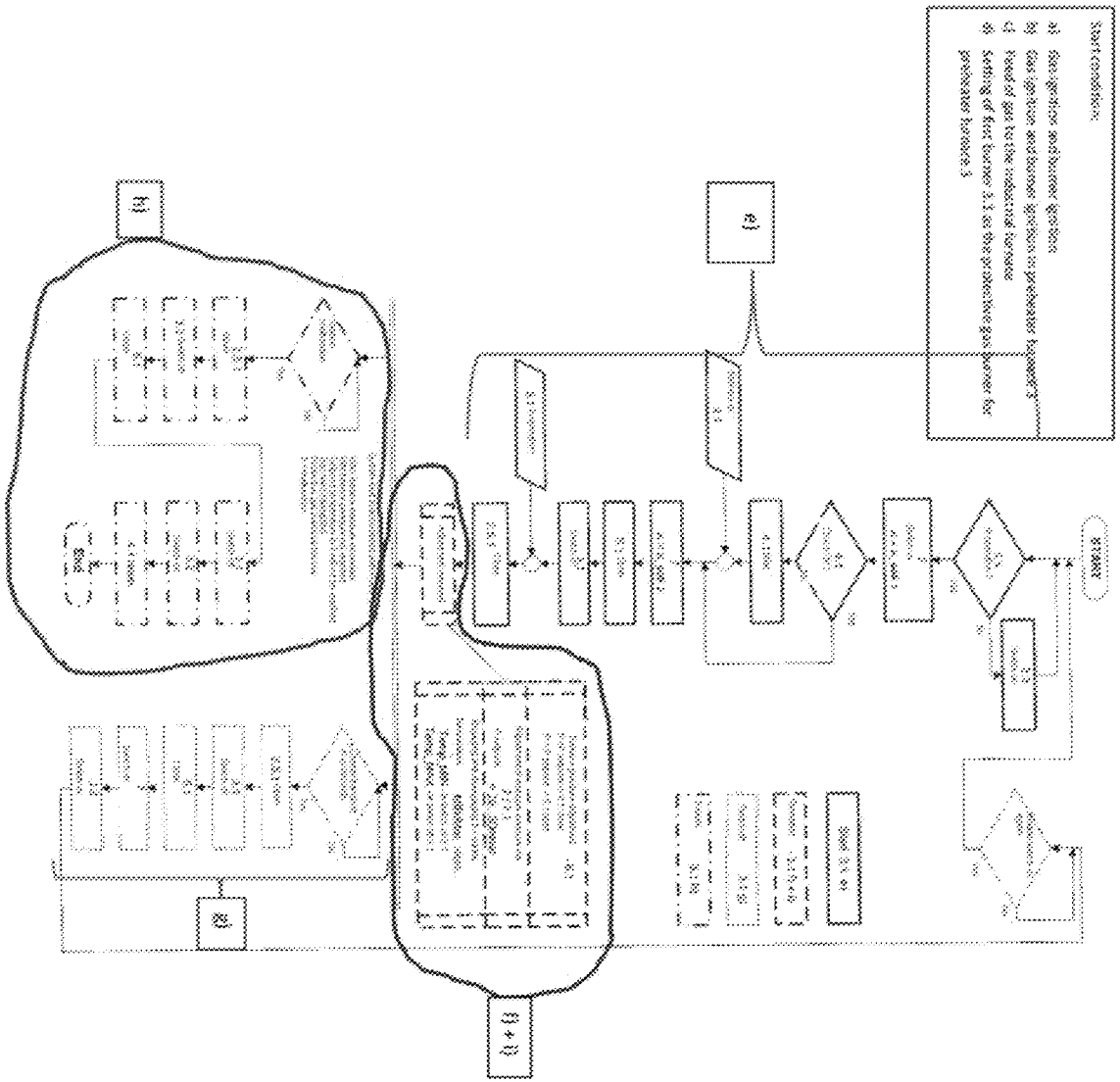
FIG. 2 shows a flowchart of an integrated process flow according to the invention, including the steps and conditions according to a program usable therefor.

FIG. 2 shows in logical sequence the process workflow for using the residual protective gas as heating gas in a software algorithm. This may be stored in control and adjustment unit 8 such that first burner 3.1 is operated with priority over second burner 1.2 to heat industrial furnace 1, second burner 3.2 is engaged additionally and operated when the output from first burner 3.1 falls below the level required to heat industrial furnace 1 to a temperature setpoint, and second burner 3.2 is switched off and not operated when the temperature setpoint has been reached.

The process steps described in the foregoing summary are identifiable in FIG. 2 by the border of the several functional blocks in the diagram. More specifically, the functional blocks associated with step e) are shown in solid line. The functional blocks associated with steps f) and i) are shown in dashed line. The functional blocks associated with step g) are shown with dotted line and the blocks associated with step h) are shown in dash-dot line.

With reference to FIG. 1

- a third burner 3.3 that is supplied with heating gas and operated as a backup ignition burner for first burner 3.1 is used,
- a UV sensor 3.4 is used for monitoring first burner 3.1,
- blower 7 is controlled via a frequency transducer,
- when the temperature rises above a temperature setpoint the output from second burner 3.2 is reduced by the actuation of air damping flap 6.1 and
- when the pressure in industrial furnace 1 rises a correspondingly greater quantity of protective gas is diverted via burn-off point 2.5, first burner 3.1 is switched off when a defined maximum pressure value is reached, burn-off point 2.5 is opened and the pressure lowered, and first burner 3.1 is switched on again if there is a requirement for output in industrial furnace 1.

The processes illustrated in FIG. 2 are identified with the reference numbers of the associated legend

- a) gas ignition and burner ignition,
- b) gas ignition and burner ignition in preheater furnace 3,
- c) gas feed to the industrial furnace,
- d) setting first burner 3.1 as the protective gas burner for preheater furnace 3,
- e) igniting first burner 3.1,
- f) operating first burner 3.1,
- g) switching off first burner 3.1,
- h) failure of first burner 3.1
- i) presence of insufficient pressure upstream of first burner 3.1 during operation thereof.

A program having the functions described in accordance with FIG. 2 is presented for enabling the process according to the invention to run automatically through the operation of control and adjusting unit 8.

In this way, the program comprising the processes indexed above with the functions integrated according to the invention ensures that

- the gas ignition and burner ignition is assured in high temperature furnace 2 by means of third controller 2.7 for feeding heating gas via feed line 4, wherein the gas ignition is triggered at first controller 3.1.1 of the gas inlet segment, after which an automatic start routine with leak testing in feed line 4 is run via second controller 3.2.1, then the supply of heating gas is enabled, and second burner 3.2 and third burner 3.3 are first primed for operation with heating gas,
- when the gas is ignited and the burner is ignited in preheater furnace 3 via second controller 3.2.1, doors 2.1, 2.2, 3.5, 3.6 are first closed and industrial furnace 1 is purged with a quantity of air equal to several times the volume of the furnace through feed line for air 6 for the indicated burners 3.1, 3.2, 3.3, then a leak test is carried out promptly on the feed line for heating gas 4 by means of leak test unit 4.1, then doors 2.1, 2.2, 3.5, 3.6 are opened and second burner 3.2 and third burner 3.3 are ignited, doors 2.1, 2.2, 3.5, 3.6 are closed following monitoring of the flame at second burner 3.2, preheating furnace 3 is heated up to an operating temperature by second burner 3.2, and third burner 3.3 remains lit until preheating furnace 3 is switched off again,
- protective gas is fed into high temperature furnace 2, which has been heated to a temperature of >750° C. via third controller 2.7, wherein main valve 5.1 of the feed line for protective gas 5 is closed for first burner 3.1 and shutoff valve 2.5.1 of burn-off position 2.5 is open, flue gas burner 2.4 of burn-off point 2.5 has already been ignited before the start of the gas feeding system, and the feed of gas to industrial furnace 1 is cut off if an excess pressure set by means of excess pressure flap 2.8 of burn-off point 2.5 is reached, and at the same time a target C-level has been established in the furnace, and the protective gas is then used to operate first burner 3.1, and
- the setting of first burner 3.1 as the protective gas burner for preheater furnace 3 causes its output to be adjusted in such manner that the quantity of available protective gas is initially set during commissioning of industrial furnace 1 following determination of
  - the burn-off quantities at burn-off point 2.5 or
  - a protective gas escape volume or
  - by means of a weight load of a non-return valve or excess pressure flap 2.8 at burn-off point 2.5 the furnace pressure is set, wherein following these adjustments and the continuous supply of protective gas to industrial furnace 1 the volume flow of protective gas with which the first burner 3.1 is supplied is fixed, so that the quantity of protective gas burned is only as much as was allowed to escape from burn-off point 2.5 formerly, that is to say without the inventive measures, wherein the furnace pressure of the pusher furnace serves as the control variable for first burner 3.1.

The program also ensures that an inlet pressure is created by blower 7 upstream of main valve 5.1 of protective gas feed line 5 so that leak testing may be carried out, the blower being controlled to force the gas towards the closed main valve 5.1, wherein burn-off point 2.5 is open during the leak test and no protective gas is yet being fed to first burner 3.1.

The program also ensures that a) first burner 3.1 is switched off when its supply with protective gas is not guaranteed, wherein preheater furnace 3 is then heated via second burner 3.2, mainly during the time when doors 2.1 and 2.2 are being opened, and when doors 2.1, 2.2, 3.5, 3.6 are open, first burner 3.1 is only operated when the furnace pressure has reached a predetermined setpoint, or b) main valve 5.1 is closed if first burner 3.1 fails and is unable to ignite due to a malfunction, in which case blower 7 is switched off, shutoff valve 2.5.1 is opened, and second burner 3.2 heats preheater furnace 3, or c) the speed of blower 7 is increased via frequency transducer 7.1 if the pressure in front of first burner 3.1 is too low, wherein the inlet pressure upstream of first burner 3.1 is used as the control variable for frequency transducer 7.1 and the target value is usually an inlet pressure in the range from 20-30 mbar.

COMMERCIAL APPLICABILITY

With this invention, residual protective gases in industrial furnaces, which were previously allowed to escape without further use, are reused as heating gas, so that the utility value of industrial furnaces and their efficient, environmentally friendly use for the industry that operates them are significantly improved.

KEY TO FIGURES

FIG. 1 and FIG. 2

1=Industrial furnace
2=High temperature furnace
2.1=Door for loading
2.2=Door for unloading
2.4=Flue gas burner
2.5=Burn-off point
2.5.1=Shutoff valve
2.6=Gas chiller
2.7=Third controller
2.8=Excess pressure flap
3=Preheater furnace
3.1=first burner
3.1.1=first controller
3.2=second burner
3.2.1=second controller
3.3=third burner
3.4=UV sensor
3.5=Door for loading
3.6=Door for unloading
4=Feed line for heating gas
4.1=Leak testing unit
5=Feed line for protective gas
5.1=Main valve
6=Feed line for air
6.1=Air damping flap, throttle flap
7=Blower
7.1=Frequency transducer
8=Control and adjustment unit

FIG. 2 a) Gas ignition and burner ignition,
b) Gas ignition and burner ignition in preheater furnace 3,
c) Feed of gas to the industrial furnace,
d) Setting of first burner 3.1 as the protective gas burner for preheater furnace 3,
e) Ignition of first burner 3.1,
f) Operation of first burner 3.1,
g) Shutoff of first burner 3.1,
h) Failure of first burner 3.1,
i) Presence of insufficient pressure upstream of first burner 3.1

The invention claimed is:

1. A gas-fired industrial heat treating furnace comprising:

a high temperature heating chamber having a first loading door and a first unloading door;

a pre-heating chamber having a second loading door and a second unloading door;

a first burner and a second burner disposed in said preheating chamber for heating the interior of said preheating chamber, the first burner being adapted to burn a combustible protective gas and the second burner being adapted to burn a conventional heating gas, means for supplying the conventional heating gas to the high temperature heating chamber and to the second burner, said conventional heating gas supply means including a pipeline, at least one control valve connected in the pipeline for regulating the flow of the conventional heating gas, and a leak test unit connected to the pipeline, control means connected to the first and second burners and to the conventional heating gas supplying means, said control means being configured for controlling operation of the first burner and the second burner in response to pressure and temperature conditions in the heat treating furnace and in response to an operating condition of the first burner such that (a) the first burner is operated with priority over the second burner, (b) the second burner is activated in addition to the first burner when the output of the first burner falls below a level required to reach a temperature set point in the preheating chamber, and (c) the second burner is switched off and not operated when the temperature set point is reached;

a combustible protective gas transferring means that includes:

a feed line connected between the high temperature heating chamber and the first burner for conducting the combustible protective gas under a pressure;

a control valve disposed in said feed line;

a frequency controlled blower connected in said feed line between the high temperature heating chamber and the control valve;

a gas chiller connected in said feed line between the high temperature heating chamber and the frequency controlled blower for reducing the temperature of the combustible protective gas;

a pressure sensor disposed in said feed line for sensing the pressure of the combustible protective gas upstream of the first burner and providing a signal that represents the pressure to said control means; and a frequency transducer connected to said control means and to said frequency controlled blower for receiving a speed signal from said control means and adjusting the speed of the frequency controlled blower in response to the speed signal;

a third burner connected to said conventional heating gas supplying means and to said control means such that said third burner is operable as a backup pilot burner for the first burner;

an air supply line connected for supplying air to the second burner; and an air damping flap valve connected in said air supply line for throttling the flow of air in said air supply line;

a burn-off point connected to receive the combustible protective gas from said high temperature chamber, said burn-off point comprising a shut-off valve and an excess pressure flap valve whereby a portion of the combustible protective gas can be burned off when the gas pressure in the high temperature heating chamber exceeds a preset pressure value;

a flue gas burner connected to receive the conventional heating gas and disposed adjacent to an outlet of the burn-off point for burning the combustible protective gas;

wherein the control means comprises:

a first controller connected to said first burner;

a second controller connected to said second burner;

a third controller connected to the combustible protective gas transferring means; and a control and adjustment unit connected to said first controller, said second controller, and said third controller, said control and adjustment unit being programmed for controlling ignition of the first and second burners via said first and second controllers respectively and for controlling the flow of the combustible protective gas to said first burner via said third controller; and the control and adjustment unit is further programmed to communicate with the first controller, the second controller, and the third controller for monitoring, controlling, and adjusting at least one of the following:

a) gas ignition and burner ignition in the high-temperature chamber, b) gas ignition and burner ignition in the pre-heating chamber, gas feed to the high-temperature furnace, c) setting of the first burner as the protective gas burner for the preheating chamber furnace, d) ignition of the first burner as the protective gas burner, e) operation of the first burner, f) switching off of the first burner, g) failure of the first burner, and h) the pressure upstream of the first burner and the speed of the frequency controlled blower during operation of the first burner; and the control and adjustment unit is also programmed to execute one or more of the following in said gas-fired industrial heat treating furnace:

a) signal the first controller to switch off the first burner when its supply with combustible protective gas is not guaranteed, whereby the pre-heating chamber is then heated by the second burner, at least during the time when the first loading and unloading doors are being opened, and when the first loading and unloading doors are open the first burner is only operated when the pressure in the high temperature heating chamber has reached a predetermined set point, b) close the control valve if the first burner fails or is unable to ignite due to a malfunction, in which case the frequency controlled blower is switched off, the shut-off valve is opened, and the second burner heats the pre-heating chamber, c) signal the third controller to increase the speed of the frequency controlled blower by means of the frequency transducer if the pressure in front of the first burner is too low, wherein the inlet pressure upstream of the first burner is used as a control variable and a target inlet pressure value is in the range from 20-30 mbar, and d) operate the third burner as a backup pilot burner for the first burner.

2. The industrial heat treating furnace as recited in claim 1 comprising a UV sensor connected to said control means and disposed in the heat treating furnace for monitoring the operation of the first burner.

3. The industrial heat treating furnace as recited in claim 1 comprising a leak testing unit connected to said conventional heating gas supplying means.

* * * * *